US006422250B1

(12) United States Patent
Wu et al.

(10) Patent No.: US 6,422,250 B1
(45) Date of Patent: Jul. 23, 2002

(54) WIRE CONNECTION DEVICE FOR FOLDING UMBRELLAS

(76) Inventors: Chieh-Chih Wu; Ching-Tsai Chen; Chen-Maan Chang, all of No. 380, Lun Mei Rd., Chang Hwa City (TW)

( * ) Notice: Subject to any disclaimer, the term of this patent is extended or adjusted under 35 U.S.C. 154(b) by 0 days.

(21) Appl. No.: 09/784,106

(22) Filed: Feb. 16, 2001

(30) Foreign Application Priority Data

Sep. 21, 2000 (CN) ..... 00254642 U

(51) Int. Cl.[7] ..... A45B 25/14
(52) U.S. Cl. ..... 135/24; 135/25.1; 135/22
(58) Field of Search ..... 135/24, 22, 25.1, 135/25.4, 20.3, 28

(56) References Cited

U.S. PATENT DOCUMENTS 5,823,214 A * 10/1998 Seidel
6,016,822 A * 1/2000 Lin et al.
6,173,722 B1 * 1/2001 Ko
6,199,571 B1 * 3/2001 Lin et al.
6,257,257 B1 * 7/2001 Shih
6,338,353 B1 * 1/2002 Chen
6,341,613 B1 * 1/2002 Wu et al.

* cited by examiner

*Primary Examiner*—Robert Canfield
(74) *Attorney, Agent, or Firm*—Rosenberg, Klein & Lee

(57) ABSTRACT

A foldable umbrella includes a finishing cap with a plurality of first ribs pivotally connected thereto and a first recess is defined in an outer periphery of the finishing cap so that a first pulley and a first pin are received in the first recess. A shaft is connected to the finishing cap and has a plurality of tubes retractably connected with each other. A control device is connected to the shaft and a runner is movably mounted to the shaft. A plurality of stretchers are pivotally connected between the runner and the first ribs. The runner has a second recess in which a second pulley and a second pin are received. A wire has a first end thereof fixedly engaged with the finishing cap and a second end of the wire reeves through the second pin, the first pin, the second pulley, the first pulley and is connected to an end member in the control device.

3 Claims, 7 Drawing Sheets

WIRE CONNECTION DEVICE FOR FOLDING UMBRELLAS

FIELD OF THE INVENTION

The present invention relates to a wire connection device for folding umbrellas. Each of the finishing cap and the runner has a recess for receiving a pulley and a pin. The wire is connected between the pulleys and the pins.

BACKGROUND OF THE INVENTION

A conventional umbrella generally includes a shaft with a runner movably mounted to the shaft. A finishing cap is connected to a top of the shaft and a plurality of ribs are pivotally and radially connected to the finishing cap so that a fabric is connected to the ribs. A plurality of stretchers are pivotally connected between the ribs and the runner. A bottom stop and a top stop are respectively received in the shaft and biased by two respective springs. When the runner is engaged with the bottom stop, the umbrella is at its folded status and when the runner is engaged with the top stop, the ribs extend and the umbrella is expanded. The runner is pushed by a user along the shaft to expand the umbrella from the lower stop to the top stop when expanding the umbrella. It is inconvenience for the users to expand the umbrella when the other hand carrying a bag or the like. An automatic umbrella is then developed and includes a control button which is pushed to let the runner run toward the finishing cap to expand the umbrella. Nevertheless, this type of automatic mechanism is not used for an umbrella having a shaft composed of more than two retractable tubes. In order to improve the shortcoming of the conventional umbrella, applicant invented a folding device for umbrella which is disclosed in U.S. patent application with application Ser. No. 09/610,529, filed Jul. 7, 2000. The folding device effectively increases the feature of the umbrella when folding or expanding the umbrella. However, the wire connection device of the umbrella is to be improved and simplified.

The present invention intends to provide a wire connection device for a folding umbrella wherein each of the runner and the finishing cap has a recess to received a pulley and a pin to connect the wires.

SUMMARY OF THE INVENTION

In accordance with one aspect of the present invention, there is provided a foldable umbrella comprising a finishing cap with a plurality of first ribs pivotally connected thereto and a first recess is defined in an outer periphery of the finishing cap. A first pulley and a first pin are received in the first recess in the finishing cap. A shaft is connected to the finishing cap and includes a plurality of tubes which are retractably connected with each other. A control device is connected to the shaft and a runner is movably mounted to the shaft. A plurality of stretchers are pivotally connected between the runner and the first ribs. A fabric is mounted to the first ribs and a spring is received in the shaft. The runner has a protrusion extending radially therefrom and a second recess is defined in the protrusion. A second pulley and a second pin are received in the second recess.

The control device comprises a base member and a central passage is defined through the base member in which an end member is movably received. The base member has a slot communicating with the central passage and a button is movably engaged with the slot. A compressing member is biased in the base member and compresses the end member. A wire has a first end thereof fixedly engaged with the finishing cap and a second end of the wire reeves through the second pin, the first pin, the second pulley, the first pulley and is connected to the end member.

The primary object of the present invention is to provide a foldable umbrella wherein the pulleys and pins are respectively received in recesses in the finishing cap and the runner so that the wire will not tangled whenever expanding or folding the umbrella.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
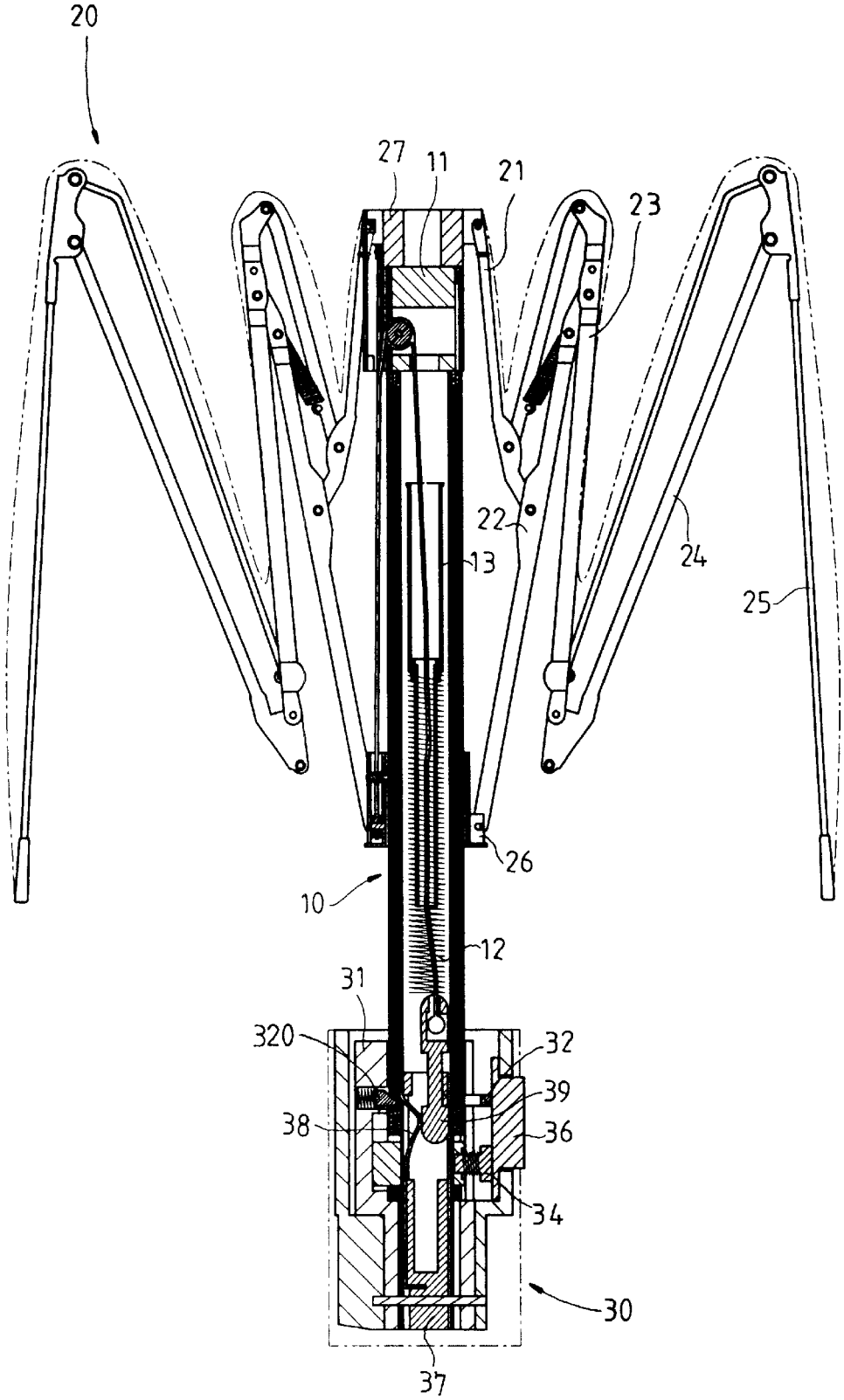
FIG. 1 is a cross sectional view to show a foldable umbrella of the present invention.
Figure 2:
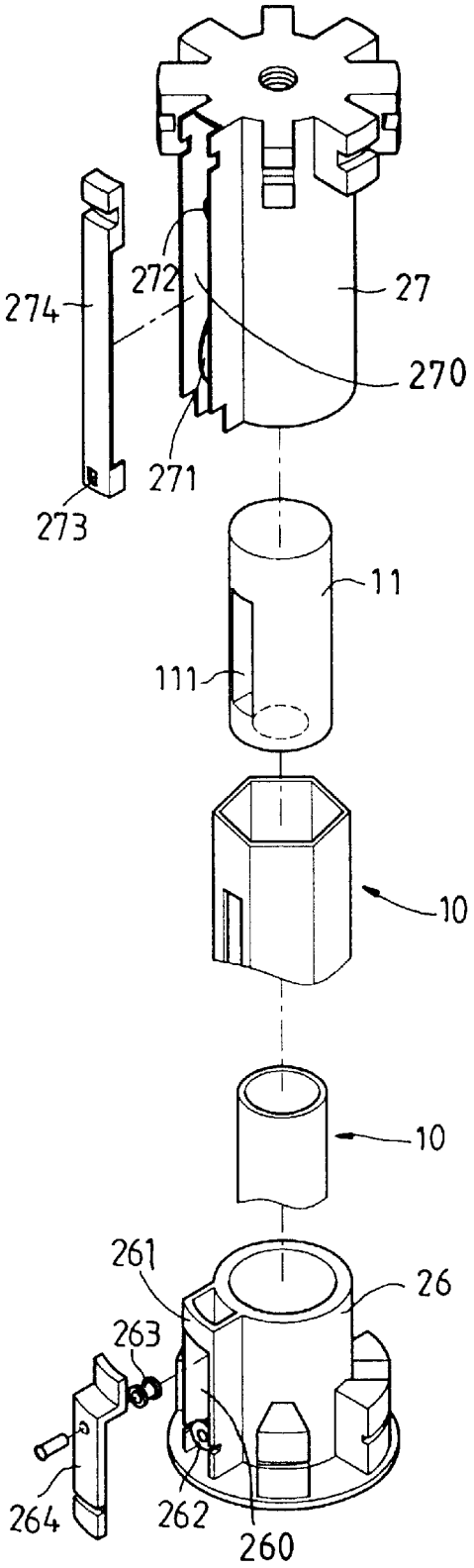
FIG. 2 is an exploded view to show a finishing cap and a runner of the umbrella of the present invention.
Figure 3:
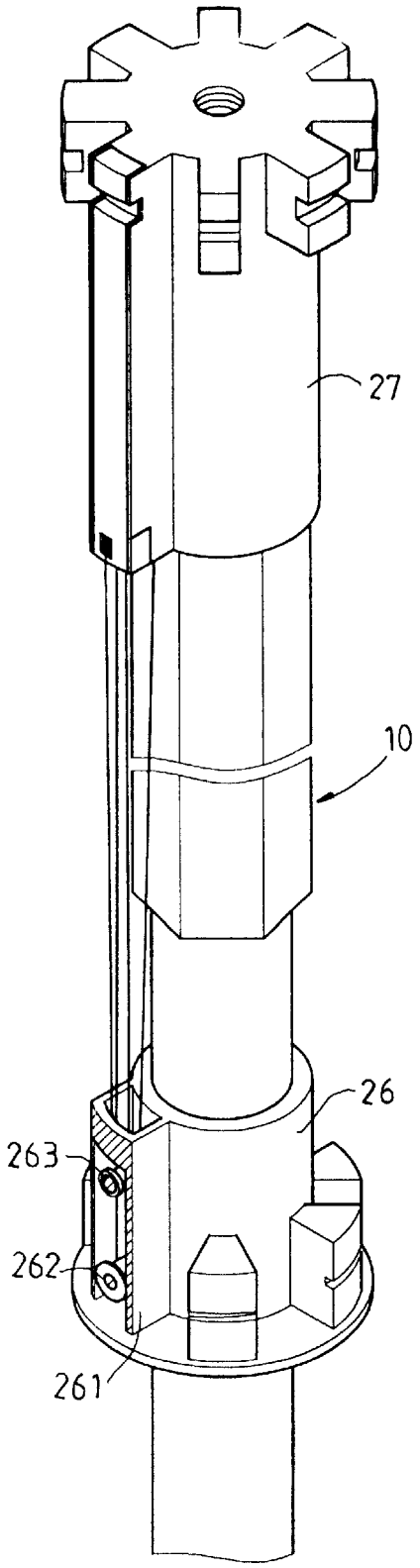
FIG. 3 is a perspective view to show the finishing cap and the runner of the umbrella of the present invention wherein a wire is connected between the finishing cap and the runner.
Figure 4:
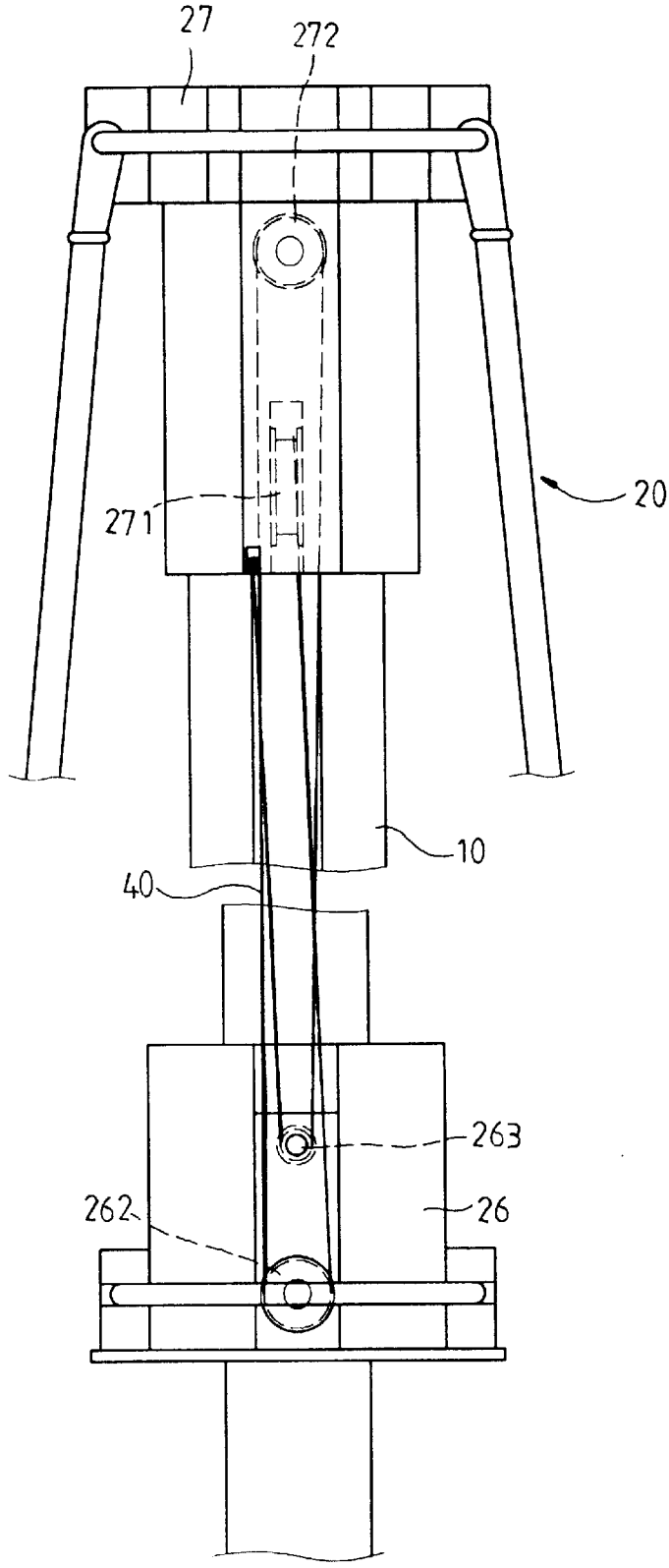
FIG. 4 is an illustrative view to show how the wire is connected between the finishing cap and the runner.
Figure 5:
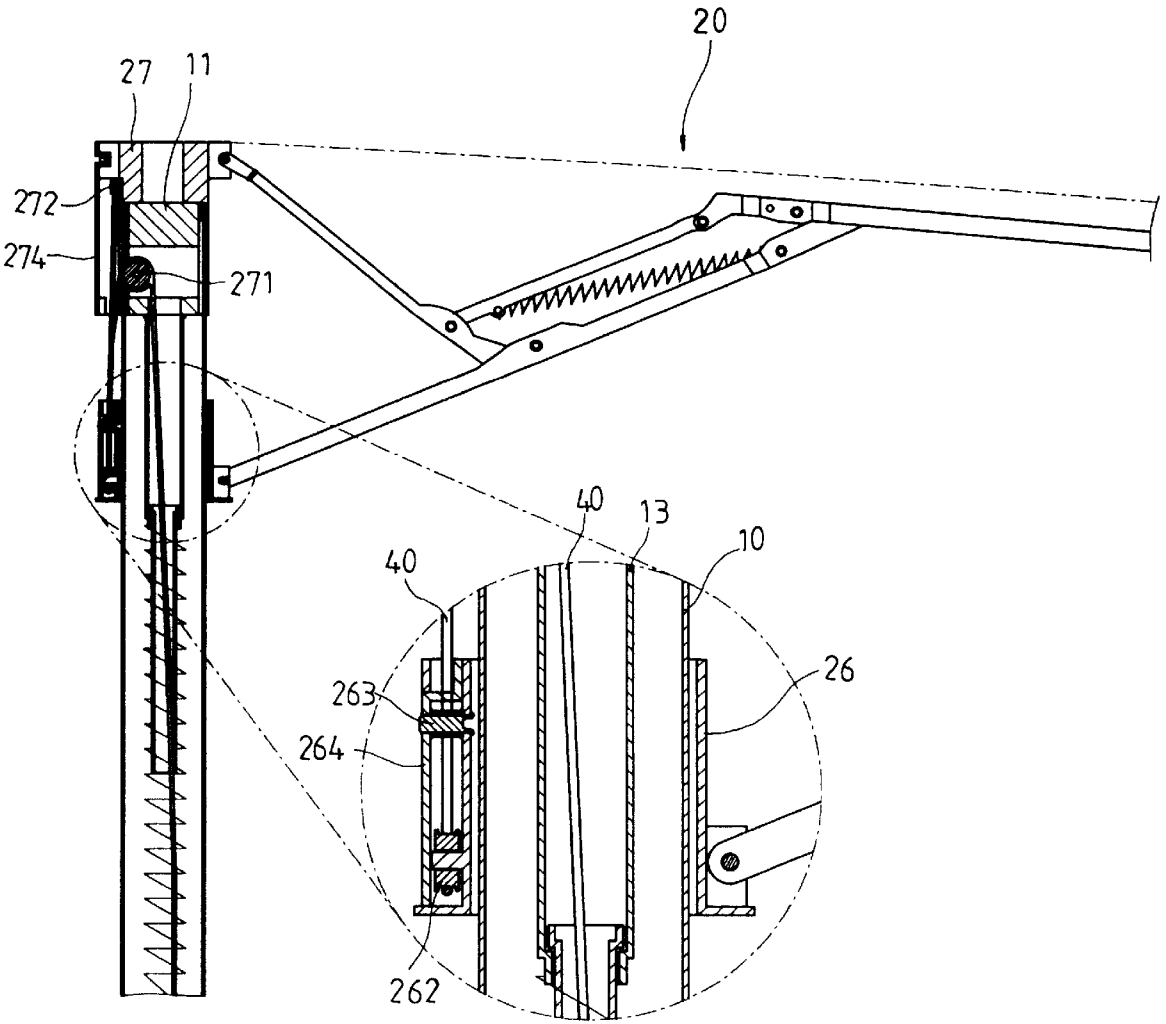
FIG. 5 is a cross sectional view to show the runner at the expanded position.

Referring to FIGS. 1 to 5, the foldable umbrella of the present invention comprises a finishing cap (27) with a plurality of first ribs (21) pivotally connected thereto. A first recess (270) is defined in an outer periphery of the finishing cap (27) and a first cover (274) is engaged with the first recess (270). A first pulley (271) and a first pin (272) are received in the first recess (270) in the finishing cap (27). A shaft (10) is connected to the finishing cap (27) and a tubular member (11) is received in an underside of the finishing cap (27). A slot (111) is defined through the tubular member (11) and communicates with a hole in the bottom of the tubular member (11). A plurality of tubes (13) which are retractably connected with each other and received in the shaft (10) which are composed by a several sections so as to allow the umbrella to be expanded and/or folded.

A control device (30) is connected to the shaft (10) and a handle section (37) is connected to a lower end of the shaft (10), A runner (26) is movably mounted to the shaft (10) and a plurality of stretchers (22) are pivotally connected between the runner (26) and the first ribs (21). The control device (30) is disclosed in applicant's prior application with Ser. No. 09/610,529. A plurality of third ribs (24) are pivotally connected to the stretchers (22) and a plurality of fourth ribs (25) are pivotally connected to the third ribs (24). A fabric (20) is mounted to the first ribs (21), the stretchers (22), the third ribs (24) and the fourth ribs (25). A spring (12) is received in the shaft (10) and connected between one of the tubes (13) and an end member (39) in the control device (30). The runner (26) has a protrusion (261) extending radially therefrom and a second recess (260) is defined in the protrusion (261). A second pulley (262) and a second pin (263) are received in the second recess (260). A second cover (264) is engaged with the second recess (260).

The control device (30) comprises a base member (31) and a central passage is defined through the base member (31) in which the end member (39) is movably received. The base member (31) has a slot communicating with the central passage and a button (36) is movably engaged with the slot. An auxiliary button (34) is connected to an inner side of the button (36) and is movably engaged with the slot in the base member (31). A compressing member (38) is biased in the base member (31) and compresses the end member (39). A ring (32) contacts the button (35) and has a tongue (320) which is inserted in aligned holes defined in the retracted sections of the shaft (10).

A wire (40) has a first end thereof fixedly engaged with a hole (273) defined through the finishing cap (27) and a second end of the wire (40) extends through the slot (111) in the tubular member (11) and through the hole in the bottom of the tubular member (11) and reeves through the second pin (263), the first pin (272), the second pulley (262), the first pulley (271) and is connected to the end member (39).

Figure 6:
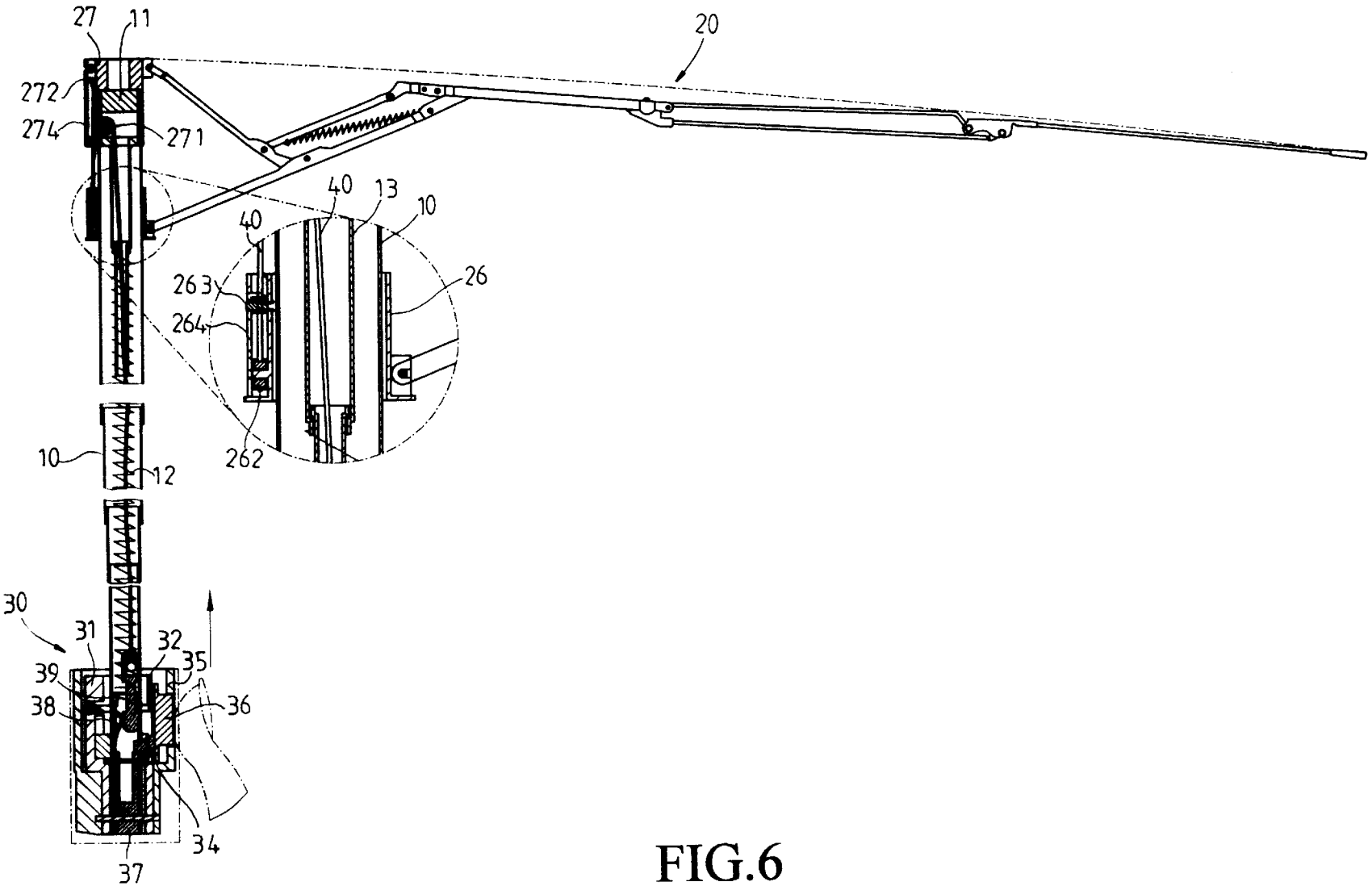
FIG. 6 shows that when a user pushes a button on the control device, the umbrella expands.
Figure 7:
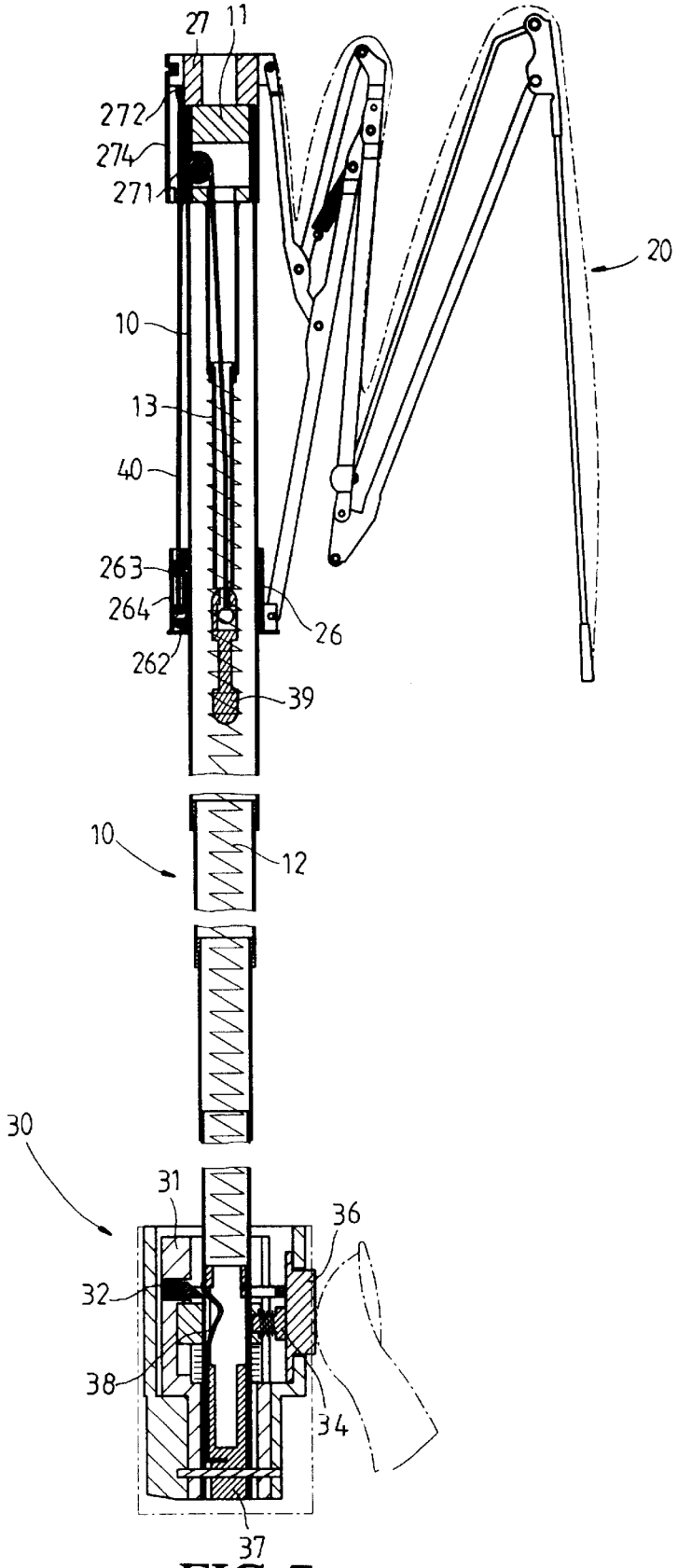
FIG. 7 shows that when a user pushes a button on the control device again, the umbrella is folded.

Referring to FIG. 6, when expanding the umbrella, the user pushes the button (36) to disengage the tongue (320) from the aligned holes of the sections and these sections of the shaft (10) are expanded by the spring (12). A distance between the end member (39) and the runner (26) is at its largest status. The wire (40) is then pulled by the movement of the runner (26). Referring to FIG. 7, when folding the umbrella, the auxiliary button (34) pushes the end member (39) to let the end member (39) run upward rapidly and the runner (26) moves downward because the tension of the wire (40) is lost.

The first recess (270) and the second recess (260) provide suitable space to receive the pulleys (271, 262) and pins (263, 272) so that the wire (40) will not be tangled during operating the umbrella.

While we have shown and described various embodiments in accordance with the present invention, it should be clear to those skilled in the art that further embodiments may be made without departing from the scope and spirit of the present invention.

What is claimed is:

1. A foldable umbrella comprising:

a finishing cap (27) with a plurality of first ribs (21) pivotally connected thereto, a first recess (270) defined in an outer periphery of said finishing cap (27), a first pulley (271) and a first pin (272) received in said first recess (270) in said finishing cap (27);

a shaft (10) connected to said finishing cap (27) and comprising a plurality of tubes which are retractably connected with each other, a control device (30) connected to said shaft (10) and a runner (26) movably mounted to said shaft (10) and a plurality of stretchers (22) pivotally connected between said runner (26) and said first ribs (21), a fabric (20) mounted to said first ribs (21) and a spring (12) received in said shaft (10), said runner (26) having a protrusion (261) extending radially therefrom and a second recess (260) defined in said protrusion (261), a second pulley (262) and a second pin (263) received in said second recess (260);

said control device (30) comprising a base member (31) and a central passage defined through said base member (3l) in which an end member (39) is movably received, said base member (31) having a slot (32) communicating with said central passage and a button (36) movably engaged with said slot (32), a compressing member (38) biased in said base member (31) and compressing said end member (39), and a wire (40) having a first end thereof fixedly engaged with said finishing cap (27) and a second end of said wire (40) reeving through said second pin (263), said first pin (272), said second pulley (262), said first pulley (271) and connected to said end member (39).

2. The foldable umbrella as claimed in claim 1 further comprising a first cover (274) engaged with said first recess (270) and said first cover (274) having a hole (273) defined therethrough, said first end of said wire (40) fixedly engaged with said hole (273).

3. The foldable umbrella as claimed in claim 1 further comprising a second cover (264) engaged with said second recess (260).

* * * * *